US006182470B1

(12) United States Patent
Guillard

(10) Patent No.: US 6,182,470 B1
(45) Date of Patent: Feb. 6, 2001

(54) AIR DISTILLATION PLANT AND CORRESPONDING COLD BOX

(75) Inventor: Alain Guillard, Paris (FR)

(73) Assignee: L'Air Liquide, Societe Anonyme pour l'Etude et l'Exploitation des Procedes Georges Claude, Paris Cedex (FR)

( * ) Notice: Under 35 U.S.C. 154(b), the term of this patent shall be extended for 0 days.

(21) Appl. No.: 09/301,123

(22) Filed: Apr. 30, 1999

(30) Foreign Application Priority Data

Apr. 30, 1998 (FR) ..... 98 05531

(51) Int. Cl.[7] ..... F25J 3/00
(52) U.S. Cl. ..... 62/646; 62/900
(58) Field of Search ..... 62/643, 646–647, 62/648, 900, 905, 911

(56) References Cited

U.S. PATENT DOCUMENTS 4,883,517 * 11/1989 Rathbone ..... 62/654
5,341,646 * 8/1994 Agrawal et al. ..... 62/900 X
5,471,843 * 12/1995 Chretien ..... 62/646
5,865,041 * 2/1999 Agrawal et al. ..... 62/643

FOREIGN PATENT DOCUMENTS 0 567 047 10/1993 (EP) .
2 143 986 2/1973 (FR) .
2 677 667 12/1992 (FR) .

* cited by examiner

*Primary Examiner*—William Doerrler
(74) *Attorney, Agent, or Firm*—Young & Thompson

(57) ABSTRACT

In this air distillation plant (1) comprising a double column and a mixing column (5), the medium-pressure column (2), the low-pressure column (3) and the mixing column (5) are placed one on top of another, forming a single erected structure.

Application to the supply of impure oxygen for the iron and steel industry.

7 Claims, 1 Drawing Sheet

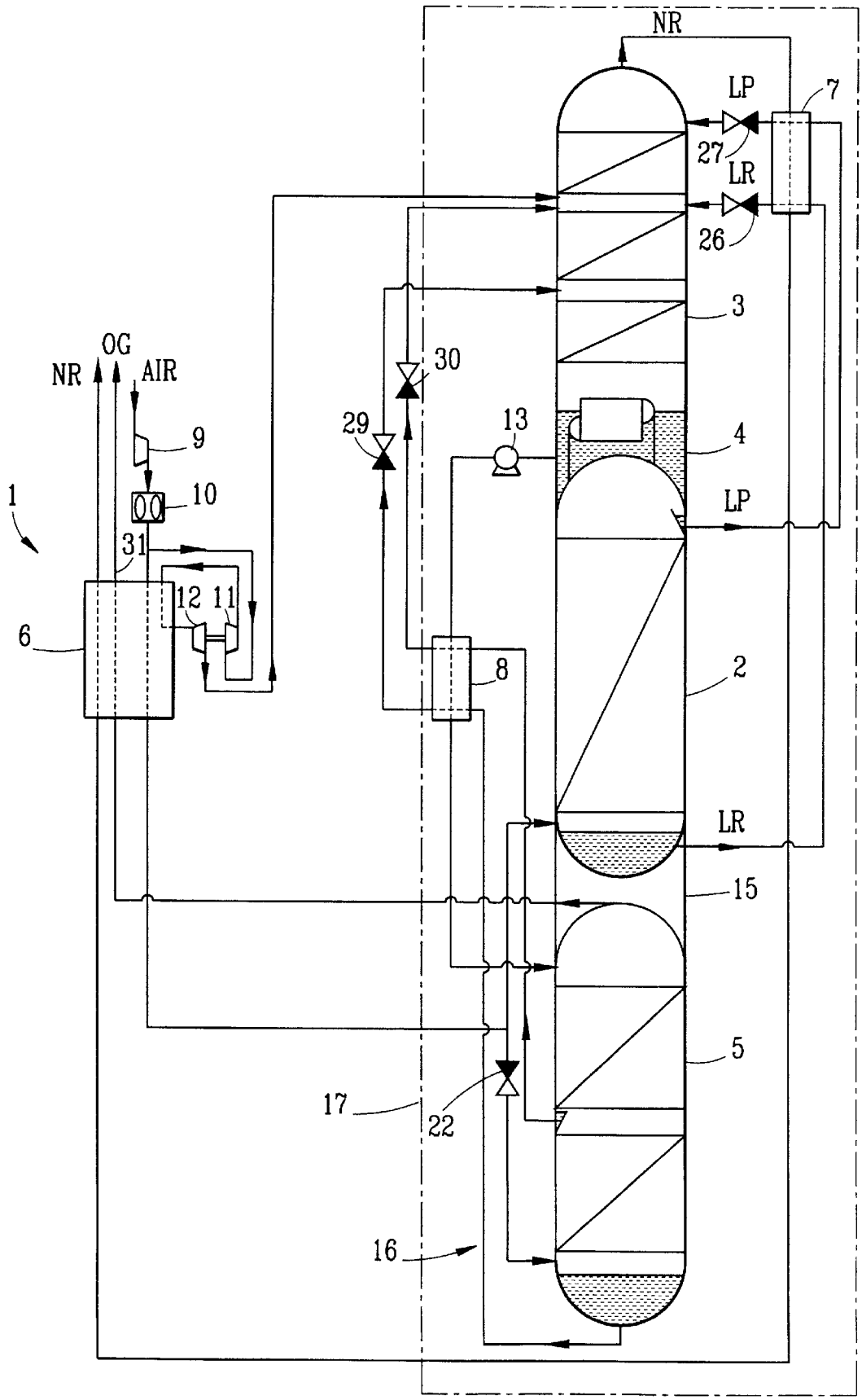
NR
LP
7
27
LR
26
3
30
OG
NR
AIR
29
13
4
9
10
1
LP
31
12
11
6
8
2
LR
15
5
17
22
16

AIR DISTILLATION PLANT AND CORRESPONDING COLD BOX

The present invention relates to an air distillation plant of the type comprising a double column and a mixing column for mixing a gas and a liquid, the double column itself comprising a medium-pressure column, a low-pressure column and a reboiler for bringing the gas at the top of the medium-pressure column into heat-exchange relationship with the liquid at the bottom of the low-pressure column, the plant furthermore comprising means for sending gaseous air into the bottom of the mixing column, means for sending an oxygen-rich liquid into the top of the mixing column and a production line for gaseous impure oxygen withdrawn from the top of the mixing column.

The invention applies particularly to the supply of impure oxygen, for example for feeding blast furnaces in the iron and steel industry.

In order to provide such a supply of impure oxygen, it is known to use a plant of the aforementioned type. The mixing column operates at a pressure approximately equal to or less than the medium pressure. It is fed at the bottom with purified and compressed air and at the top with impure liquid oxygen removed from the bottom of the low-pressure column and brought by pumping to the pressure of the mixing column. The impure gaseous oxygen to be supplied is withdrawn from the top of such a mixing column approximately at the pressure of the mixing column.

In general, the low-pressure column sits on top of the reboiler, which itself sits above the medium-pressure column. The double column then forms a first structure erected on site and the mixing column is placed beside the double column, forming a second erected structure. Each erected structure is surrounded by a thermal insulation jacket which holds perlite around the erected structure forming a cold box.

Moreover, it is desirable to prefabricate air distillation plants in packets which each comprise a structure and the thermal insulation jacket of a cold box. Each packet is transported onto a site and then erected. Next, the erected structures are functionally connected and the cold boxes filled with perlite in order to complete the construction of the air distillation plant.

Such a method of construction makes it possible to limit the construction operations on the site, where on the one hand, all the necessary infrastructures may not be available and, on the other hand, the environmental conditions may impede the construction operations.

The object of the invention is to provide an air distillation plant of the aforementioned type, in which the degree of prefabrication may be higher.

For this purpose, the object of the invention is an air distillation plant of the aforementioned type, characterized in that the medium-pressure column, the low-pressure column and the mixing column are placed one on top of another, forming a single erected structure.

Depending on the particular embodiments, the plant may comprise one or more of the following characteristics, taken in isolation or in any technically possible combination:

- the plant furthermore comprises means for sending gaseous air into the bottom of the mixing column, means for sending an oxygen-rich liquid into the top of the mixing column and a production line for gaseous impure oxygen withdrawn from the top of the mixing column;
- the erected structure also comprises the reboiler;
- the mixing column is placed under the medium-pressure and low-pressure columns;

- the medium-pressure column is placed under the low-pressure column; and
- the reboiler is placed at least partly at a level intermediate between the top of the medium-pressure column and the bottom of the low-pressure column.

The subject of the invention is also a cold box intended for the construction of such a plant as defined above, characterized in that it comprises the said erected structure and a thermal insulation jacket surrounding the said structure.

The invention will be more clearly understood on reading the description which follows, given solely by way of example and with reference to the single FIGURE which is a diagrammatic view of a plant according to the invention.

The single FIGURE shows an air distillation plant 1 which essentially comprises:

- a double distillation column which includes a medium-pressure column 2, a low-pressure column 3 and a reboiler 4;
- a mixing column 5;
- a main heat-exchange line 6;
- two auxiliary heat exchangers 7 and 8;
- a main air compressor 9;
- an apparatus 10 for purifying air by absorption;
- an auxiliary air compressor 11 coupled to an air-expansion turbine 12; and
- a pump 13.

The low-pressure column 3 sits on top of the reboiler 4. The reboiler 4 sits on top of the medium-pressure column 2 which itself sits on top of the mixing column 5.

A linking skirt 15 connects the columns 2 and 5, keeping the top of the column 5 separated from the bottom of the column 2.

The columns 2, 3 and 5 and the reboiler 4 thus form a single erected structure 16, the top of which consists of the low-pressure column 2 and the base of which consists of the mixing column 5.

This structure 16 is surrounded by a thermal insulation jacket 17 (in dot-dash line) which holds the perlite (not shown) around the structure 16, forming a cold box bearing the same numerical reference 17.

The operation of this plant 1, intended to supply medium-pressure impure oxygen, is as follows.

The air to be distilled, precompressed by the compressor 9 and purified by the apparatus 10, is then split into two streams.

A first stream passes through the main heat-exchange line 6, being cooled down to near its dew point.

Next, this first stream is itself split into two streams, one of which is injected into the bottom of the medium-pressure column 2 and the other of which is injected, after expansion in an expansion valve 22, into the bottom of the mixing column 5.

The second stream of compressed and purified air is compressed by the compressor 11, then cooled to an intermediate temperature by passing partially through the main heat-exchange line 6 and, finally, expanded on passing through the turbine 12. Next, this second stream is introduced into the low-pressure column 3 at an upper intermediate level.

The reboiler 4 vaporizes the liquid oxygen, of approximately 98% purity, coming from the bottom of the low-pressure column 3 by condensing the nitrogen at the top of the medium-pressure column 2.

"Rich liquid" LR (oxygen-enriched air), bled off from the bottom of the medium-pressure column 2, is supercooled on passing through the auxiliary heat exchanger 7, then expanded in an expansion valve 26 and finally injected into the low-pressure column 3 at the aforementioned upper intermediate level.

"Depleted liquid" LP (nearly pure nitrogen), bled off from the top of the medium-pressure column 2, is supercooled on passing through the auxiliary heat exchanger 7, then expanded in an expansion valve 27 and finally injected into the top of the low-pressure column 3.

Impure or "residual" nitrogen NR, withdrawn from the top of the low-pressure column 3, is warmed firstly on passing through the auxiliary heat exchanger 7 and then secondly on passing through the main heat-exchange line 6.

The operation of the mixing column 5 will now be described.

A mixing column is a column which has the same structure as a distillation column but which is used for mixing, in a manner close to reversibility, a relatively volatile gas introduced at the base of the column and a less volatile liquid introduced at the top of the column. Such mixing produces the refrigerating energy and therefore allows the consumption of energy associated with the distillation to be reduced. Such a column is, for example, described in document FR-A-2, 143, 986. In the present case, this mixture is furthermore positively used to produce impure oxygen directly at a pressure slightly below that prevailing in the medium-pressure column 2.

Thus, liquid oxygen is withdrawn from the bottom of the low-pressure column 3, then pumped by the pump 13 and warmed on passing through the auxiliary heat exchanger 8. Next, this liquid oxygen is introduced into the top of the mixing column 5.

A second oxygen-rich liquid is bled off from the bottom of the mixing column 5 and then supercooled on passing through the auxiliary heat exchanger 8. Finally, the second rich liquid is expanded in an expansion valve 29 before being introduced into the low-pressure column 3 at a lower intermediate level.

Oxygen-enriched air, in liquid form, is withdrawn from an intermediate level of the mixing column 5 and then supercooled on passing through the auxiliary heat exchanger 8. Finally, this liquid is expanded in an expansion valve 30 before being introduced into the low-pressure column 3 at the aforementioned upper intermediate level.

Impure gaseous oxygen, of approximately 95% purity, is bled off from the top of the mixing column and then warmed on passing through the main heat-exchange line 6 and delivered via a production line 31.

The cold box 17 was prefabricated in the form of a factory-assembled packet, then transported, erected and functionally connected to the other pieces of equipment on site and then filled with perlite in order to form the plant 1.

The height of this cold box 17 is less than 40 m. Thus, the corresponding packet may be transported by conventional transportation means.

This relatively low height is due to the process employed by the plant 1. This is because the number of theoretical trays of the medium-pressure column 2 and of the low-pressure column 3 is relatively small. Thus, the respective heights of the columns 2 and 3 are about 10 m and 15 m.

In addition, the number of theoretical trays of the mixing column 5 is relatively small and the height of this column 5 is about 15 m.

The plant 1 according to the invention may be prefabricated as a single transportable packet which comprises both the double distillation column and the mixing column 5.

The relative positioning of the medium-pressure column 2, the low-pressure column 3 and the mixing column 5 makes it possible, on the one hand, for the liquids to flow from and to the reboiler 4 without using pumping means, by placing the reboiler 4 between the medium-pressure column 2 and the low-pressure column 3.

According to variants, the structure 16 may comprise, in addition to the columns 2, 3 and 5, a tank for storing a cryogenic liquid, especially liquid oxygen, withdrawn from the bottom of the medium-pressure column, a section of an impure-argon production column, called a mixture column, or any other element for confining a cryogenic fluid, care being take not to exceed the size limits of the transportation means to be used.

According to another variant, the mixing column may comprise a bottom condenser, the plant 1 then being of the type described in document EP-A-732,556.

In addition, the order of the columns 2, 3 and 5, and of the reboiler 4, in the structure 16 may be different from that in FIG. 1.

Moreover, the erected structure 16 may not include the reboiler 4, which is then placed beside the erected structure 16.

In both cases, the reboiler 4 is preferably placed so that part of it is at a level intermediate between the top of the medium-pressure column 2 and the bottom of the low-pressure column 3.

Such an arrangement makes it possible to minimize the pumping means necessary for circulating, on the one hand, liquid oxygen from the bottom of the low-pressure column 3 to the reboiler 4 and, on the other hand, condensed gaseous nitrogen from the reboiler 4 to the top of the medium-pressure column 2, this being so whatever the type of reboiler 4, namely of the bath type, liquid-oxygen falling-film type (so-called film reboiler), etc.

This characteristic may be obtained, if the reboiler 4 does not form part of the erected structure 16, by placing the reboiler 4 at the top of another erected structure. This other erected structure comprises, for example, an element for confining a cryogenic fluid, such as a section of an impure-argon production column, on which the reboiler 4 is placed.

Such a variant furthermore has the advantage that the prefabrication of the cold box 17 is independent of that of the reboiler 4.

What is claimed is:

1. Air distillation plant (1) of the type comprising a double column and a mixing column (5) for mixing a gas and a liquid, the mixing column being free from a reboiler or a condenser, the double column itself comprising a medium-pressure column (2), a low-pressure column (3) and a reboiler (4) for bringing the gas at the top of the medium-pressure column into heat-exchange relationship with the liquid at the bottom of the low-pressure column, characterized in that the medium-pressure column (2), the low-pressure column (3) and the mixing column (5) are placed one on top of another, forming a single erected structure (16).

2. Plant according to claim 1, characterized in that the plant furthermore comprises means for sending gaseous air into the bottom of the mixing column, means for sending an oxygen-rich liquid into the top of the mixing column and a production line for gaseous impure oxygen withdrawn from the top of the mixing column.

3. Plant according to claim 1, characterized in that the erected structure (16) also includes the reboiler (4).

4. Plant according to claim 1, characterized in that the mixing column (5) is placed under the medium-pressure (2) and low-pressure (3) columns.

5. Plant according to claim 1, characterized in that the medium-pressure column (2) is placed under the low-pressure column (3).

6. Plant according to claim 1, characterized in that the reboiler (4) is placed at least partly at a level intermediate between the top of the medium-pressure column (2) and the bottom of the low-pressure column (3).

7. Cold box (17) intended for the construction of a plant according to claim 1, characterized in that it comprises the said erected structure (16) and a thermal insulation jacket (17) surrounding the said structure.

* * * * *